US007611609B1

(12) United States Patent
Valia et al.

(10) Patent No.: US 7,611,609 B1
(45) Date of Patent: Nov. 3, 2009

(54) METHOD FOR PRODUCING BLAST FURNACE COKE THROUGH COAL COMPACTION IN A NON-RECOVERY OR HEAT RECOVERY TYPE OVEN

(75) Inventors: Hardarshan S Valia, Highland, IN (US); William J Ambry, Hammond, IN (US)

(73) Assignee: ArcelorMittal Investigacion y Desarrollo, S. L., Sestao, Bizkaia (ES)

( * ) Notice: Subject to any disclaimer, the term of this patent is extended or adjusted under 35 U.S.C. 154(b) by 794 days.

(21) Appl. No.: 09/846,829

(22) Filed: May 1, 2001

(51) Int. Cl.
*C10B 45/02* (2006.01)
*C01B 31/00* (2006.01)

(52) U.S. Cl. ..... 201/5; 201/6; 201/20; 201/22; 202/248; 202/251; 264/29.1; 264/29.6

(58) Field of Classification Search ..... 201/5, 201/6, 20, 22, 24; 202/248, 251; 264/29.1, 264/29.6
See application file for complete search history.

(56) References Cited

U.S. PATENT DOCUMENTS 3,619,148 A * 11/1971 Wilde ..... 44/568
3,652,403 A 3/1972 Knappstein et al.
3,772,155 A 11/1973 Knappstein et al.
3,907,648 A * 9/1975 Nire et al. ..... 201/6
3,959,083 A 5/1976 Goedde et al.
4,123,216 A 10/1978 Leibrock
4,128,402 A 12/1978 Leibrock et al.
4,141,793 A * 2/1979 Aoki et al. ..... 201/6
4,142,941 A * 3/1979 Weber et al. ..... 201/6
4,186,054 A * 1/1980 Brayton et al. ..... 201/6
4,248,671 A 2/1981 Belding (Continued)

FOREIGN PATENT DOCUMENTS

EP 0 596 870 5/1994

(Continued)

OTHER PUBLICATIONS

Valla, Hardarshan S., "Coke Production for Blast Furnace Ironmaking", www.steel.org/learning/howmade/coke_production.htm, Aug. 24, 1999, 5 pages.

(Continued)

*Primary Examiner*—N. Bhat
(74) *Attorney, Agent, or Firm*—Baker & Daniels LLP

(57) ABSTRACT

A method for producing non-recovery/heat recovery coke may include the steps of providing a container, disposing a volume of loose coal into the container such that a vertical dimension of the volume of loose coal in the container is smaller than a horizontal dimension of the volume of loose coal, applying a force to the coal in the container to produce a volume of compacted coal having a substantially uniform density which is larger than that of the loose coal, disposing the compacted coal into a non-recovery/heat recovery type oven, and heating the compacted coal to produce coke. The method may also include the steps of providing a container, and moving the non-recovery/heat recovery coke mass from the oven at a substantially constant elevation to the container, quenching the coke mass in the container to produce a quenched coke mass, and removing the quenched coke mass from the container.

4 Claims, 4 Drawing Sheets

U.S. PATENT DOCUMENTS

| | | | | | |
|---|---|---|---|---|---|
| 4,257,848 | A | | 3/1981 | Brayton et al. | |
| 4,274,923 | A | | 6/1981 | Mahar | |
| 4,285,772 | A | | 8/1981 | Kress | |
| 4,419,186 | A | * | 12/1983 | Wienert | 201/6 |
| 4,606,876 | A | | 8/1986 | Yoshida et al. | |
| 4,726,465 | A | | 2/1988 | Kwasnik et al. | |
| 5,151,159 | A | * | 9/1992 | Wolfe et al. | 202/118 |
| 5,190,617 | A | | 3/1993 | Kress et al. | |
| 5,345,994 | A | | 9/1994 | Kato et al. | |
| 5,423,951 | A | * | 6/1995 | Wienert | 201/6 |
| 5,725,993 | A | * | 3/1998 | Bringley et al. | 430/269 |
| 6,059,932 | A | * | 5/2000 | Sturgulewski | 202/262 |
| 6,290,494 | B1 | * | 9/2001 | Barkdoll | 432/121 |
| 6,332,957 | B1 | * | 12/2001 | Gross et al. | 201/6 |
| 2004/0079628 | A1 | * | 4/2004 | Eatough et al. | 201/7 |

FOREIGN PATENT DOCUMENTS

| | | |
|---|---|---|
| JP | 7109467 | 4/1995 |
| WO | WO 90/12074 | 10/1990 |
| WO | WO 91/02781 | 3/1991 |
| WO | WO 88/08442 | 11/1998 |

OTHER PUBLICATIONS

Chatterjee, A. and H.N. Prasad, "Advent of Stamp Charging—a Boon for Cokemaking in Integrated Steel Plants in India", Cokemaking International, Jan. 1994, vol. 6, 8 pages.
Search Report, "Coke Patents", Mar. 19, 1996 32 pages.
Search Report, "Coke Patents", Mar. 19, 1996, 50 pages.
Search Report, "Coke Patents", Aug. 9, 1999, 15 pages.
Search Report, "Coke Patents", Aug. 9, 1999, 33 pages.

* cited by examiner

METHOD FOR PRODUCING BLAST FURNACE COKE THROUGH COAL COMPACTION IN A NON-RECOVERY OR HEAT RECOVERY TYPE OVEN

FIELD OF THE INVENTION

The present invention relates to a method for producing blast furnace coke in a non-recovery or heat recovery type coke oven.

BACKGROUND OF THE INVENTION

Coke is a necessary ingredient in the production of steel. Specifically, coke acts as the fuel source in the blast furnaces used to produce steel.

Coke is manufactured by heating coal to a very high temperature. Conventionally, the heating occurs either in a by-product type oven, a non-recovery type oven, or a heat recovery type oven.

The by-product type oven and the non-recovery and heat recovery type ovens are distinguishable from each other operationally and structurally. In the by-product type oven, the by-products of the coking process are used in other processes in an attempt to maximize the efficiency of the coking process. In the non-recovery and heat recovery type ovens, as the name suggests, no attempt is made to recover the chemical by-products of the coking process. In the heat recovery type oven, the waste gases generated during the non-recovery carbonization process are used to generate steam, which in turn is used generally to generate electricity. In the by-product type oven, the coal is loaded from the top, and the product is removed by pushing the coke out of one of the sides. In the non-recovery and heat recovery type ovens, generally the oven is charged either through single or multiple openings and discharged through a single opening. Unless otherwise indicated, the term "non-recovery type oven" as used herein includes heat recovery type ovens.

All of these ovens usually have a non-uniform coal bulk density after initially charging the oven. Also, the removal of the coke from all of these ovens usually involves an elevation change, which can result in breakage. As a consequence, more of the coke oxidizes, decreasing yield and increasing emissions. This breakage results in a relatively unknown amount of coke surface area being exposed during the quenching process which follows the coking process. It is thus difficult to estimate the required amount and location of quenching material to be applied and the appropriate location to which the quenching material should be applied. Consequently, the moisture content of the coal is quite variable. Uniquely the coal and coke bed in non-recovery and heat-recovery ovens are exposed to oxidizing atmosphere which can decrease the coke yield; however, the drop in yield may be partially offset by carbon deposition.

SUMMARY OF THE INVENTION

According to an aspect of the present invention, a method for producing coke includes the steps of providing a container, disposing a volume of loose coal into the container such that a vertical dimension of the volume of loose coal in the container is smaller than the horizontal dimensions of the volume of loose coal, and applying a force to the volume of loose coal in the container to produce a volume of compacted coal having a substantially uniform density which is larger than that of the loose coal disposed in the container. The method also includes the steps of disposing the volume of compacted coal into a non-recovery type oven, and heating the volume of compacted coal to produce coke.

According to another aspect of the present invention, a method of producing coke includes the steps of disposing a volume of coal into a non-recovery type oven having an oven floor, heating the volume of coal to produce a substantially uniform coke mass, providing a container, and moving the coke mass from the oven at a substantially constant elevation to the container. The method also includes the steps of quenching the coke mass in the container to produce a quenched coke mass, and removing the quenched coke mass from the container.

According to a further aspect of the present invention, a method of producing coke includes the steps of providing a first container, disposing a volume of loose coal into the first container such that a vertical dimension of the volume of loose coal in the first container is smaller than the horizontal dimensions of the volume of loose coal, applying a force to the volume of loose coal in the first container to produce a volume of compacted coal having a substantially uniform density which is greater than that of the loose coal disposed in the first container, and disposing the volume of compacted coal into a non-recovery type oven having an oven floor. The method also includes the step of heating the volume of compacted coal to produce a substantially uniform coke mass. In addition, the method includes the steps of providing a second container, moving the coke mass from the oven at a substantially constant elevation to the second container, quenching the coke mass in the second container to produce a substantially uniformly quenched coke mass, and removing the quenched coke mass from the second container.

These and other features of the present invention will become more apparent and the invention will be better understood upon consideration of the following description and the accompanying drawings:

DETAILED DESCRIPTION OF EMBODIMENTS OF THE INVENTION

The embodiments of the invention described herein are not intended to be exhaustive or to limit the invention to the precise forms disclosed. Rather, the embodiments selected for description have been chosen to enable one skilled in the art to practice the invention.

Figure 1:
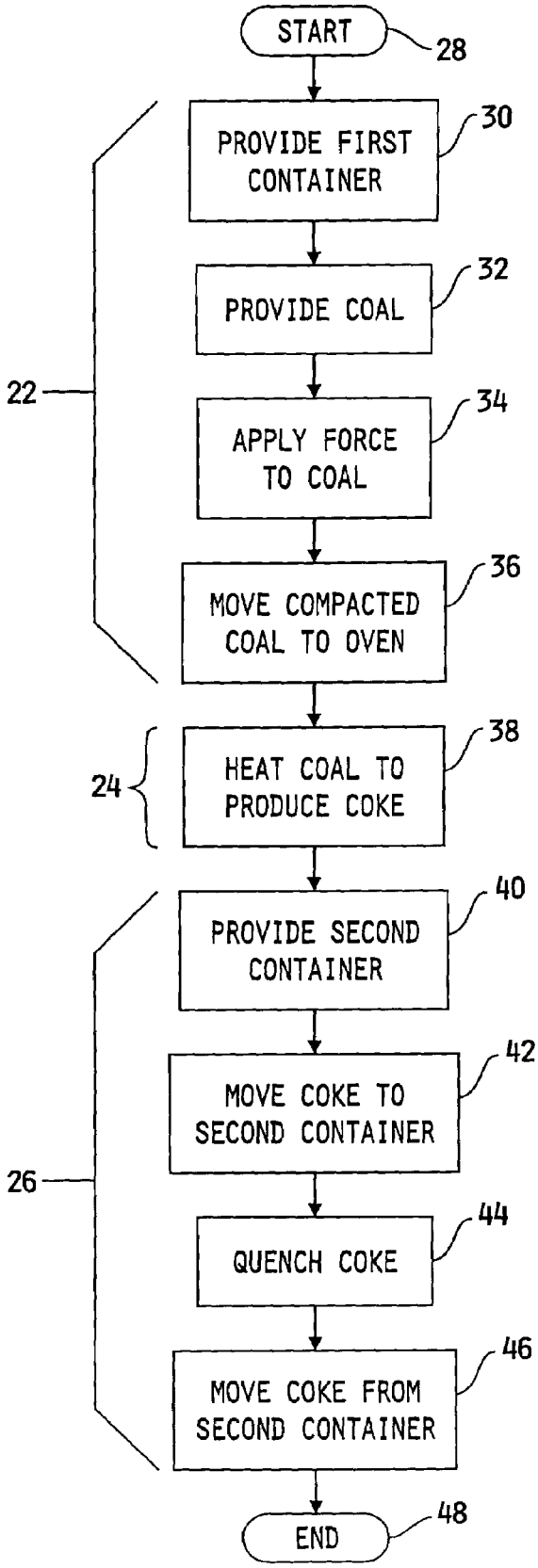
FIG. 1 is a flowchart of a method for producing coke including compacting a coal charge for a non-recovery type oven and removing a coke mass from a non-recovery type oven according to the present invention.

A method of producing coke in a non-recovery type oven according to an embodiment of the present invention is shown in FIG. 1. The method shown in FIG. 1 includes a pre-carbonization stage 22, a carbonization stage 24, and a post-carbonization stage 26.

While the method includes all three stages, 22, 24, 26, it will be recognized that the pre-carbonization stage 22 could be used advantageously independently from the post-carbonization stage 26, and vice versa. That is, advantages may be achieved by using only the pre-carbonization stage 22 or the post-carbonization stage 26 of the method to produce coke. To simplify the overview of the invention, however, the stages 22, 26 have been illustrated as parts of a single method.

The method starts at a step 28. At a step 30, a first container in the shape of a rectangular horizontal box is provided, and at a step 32, a volume of loose coal is disposed in the first container. The volume of loose coal has a vertical dimension which is considerably smaller than its horizontal dimensions. A force is applied to the volume of loose coal in the first container at a step 34. The force applied to the volume of loose coal compacts the coal together, producing a volume of compacted coal having a substantially uniform density greater than that of the volume of loose coal initially disposed in the first container. At a step 36, the volume of compacted coal is moved from the first container into a non-recovery type oven, where it is heated at a step 38 to produce a substantially uniform coke mass.

A second container in the shape of a rectangular horizontal box is provided at a step 40, preferably with a bottom wall of the second container on a similar elevation with a floor of the non-recovery oven. The coke is then moved from the non-recovery oven to the second container at a substantially constant elevation at a step 42. At a step 44, the second container and coke contained therein are moved to a quenching station, where the coke is quenched, for example, with water, to cool the coke. The quenched coke is then removed from the container at a step 46, and the method ends at a step 48.

The method described above has several advantages over conventional methods of producing coke using non-recovery type ovens.

In particular, relative to the pre-carbonization stage 22, the compaction of the coal will result in an increase in coal bulk density through a reduction in the interparticle void spaces. Through the reduction in the interparticle void spaces, better wetting, bonding, and interaction will occur between the coal particles upon heating. By increasing the particle interaction, the coke quality and yield will be increased and energy efficiency during carbonization will be improved. Additionally, the coke should be less susceptible to breakage and the moisture within the coke should be better controlled. Also, the coal ash fusion reactions with the refractory inside of the oven chamber and the initial charging emissions should be decreased.

Further, relative to the post-heating stage 26, by avoiding elevation changes which might break up the coke, less surface area is exposed. Less exposed surface area leads to smaller yield losses because of oxidization of the coke, and to smaller amounts of particulate emissions. Moreover, because the coke mass is substantially uniform, the calculation of the amount of quenching material (e.g., water) required can be refined over conventional methods, allowing for lower average coke moisture and lower average moisture variation.

The pre-carbonization and post-carbonization stages 22, 26 of the method are now discussed in greater detail with reference to FIGS. 2-5.

Figure 2:
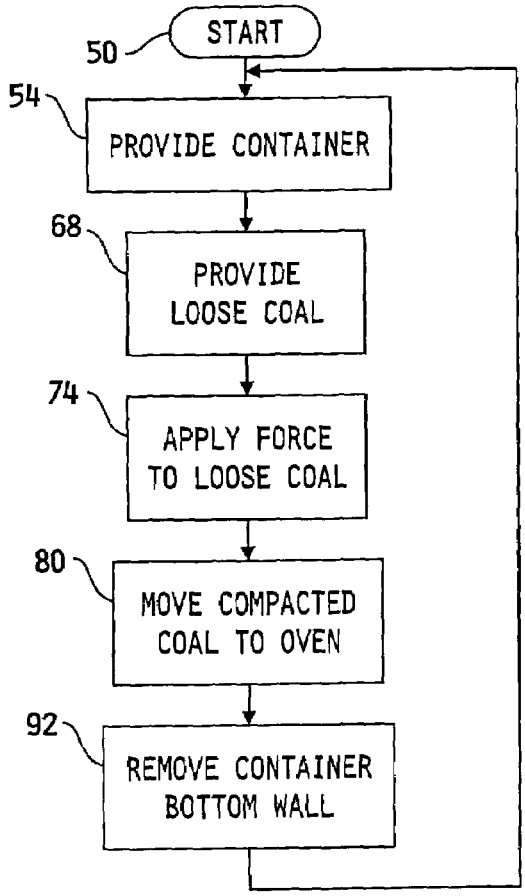
FIG. 2 is a flowchart of a method of compacting a coal charge for a non-recovery oven according to the present invention.

The pre-carbonization stage 22 is shown in FIGS. 2 and 3. FIG. 2 shows the steps of the pre-carbonization stage 22 in greater detail than is shown in FIG. 1, while FIGS. 3A-3H illustrate the apparatus used for carrying out the steps of the pre-carbonization stage 22.

Figure 3A:
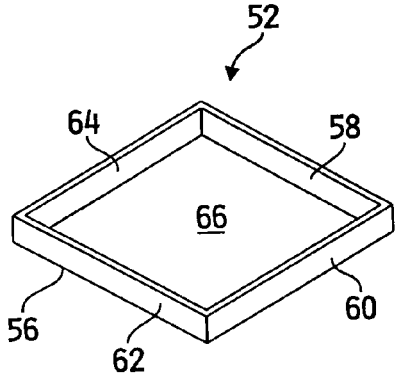
FIGS. 3A-3H are schematic views of an apparatus for compacting a coal charge for a non-recovery oven according to the present invention.

Starting initially at a step 50, a container 52 is provided at a step 54, as shown in FIG. 3A. While the container 52 may have any of a number of different shapes, the illustrated container 52 is parallelepiped-shaped structure having five walls: a bottom wall 56 and four side walls 58, 60, 62, 64. The illustrated container 52 does not have a sixth, or top, wall, so as to permit unrestricted access to a space 66 defined in part by the walls 56, 58, 60, 62, 64. A partial top wall may be included, provided the wall does not interfere with the other steps of the pre-carbonization stage 22.

Figure 3B:
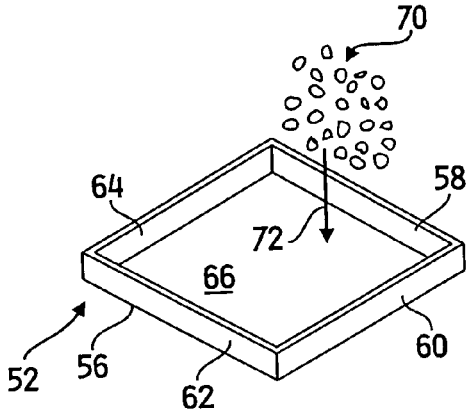
Figure 3C:
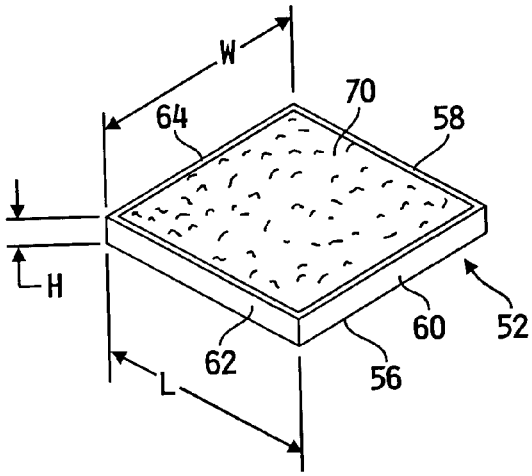

As illustrated in FIGS. 3B and 3C, at a step 68, a volume of loose coal 70 is disposed into the container 52 (as shown by an arrow 72), and in particular into the space 66. It will be recognized that the volume of loose coal 70 fills the space 66 such that the volume of loose coal 70 has a vertical dimension, h, which is substantially smaller than its horizontal dimensions, w and l.

Figure 3D:
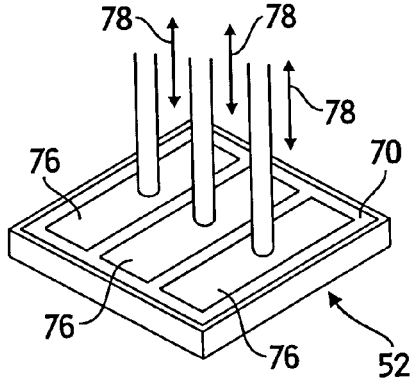

At a step 74, a force is applied to the volume of loose coal 70, as shown in FIG. 3D. For example, a plurality of plates 76 may be provided. Alternatively, a plurality of hammers or rollers may be substituted for the plates 76, or a single mass may be used. The plates 76 are driven, for example by a drive screw, in an up-and-down fashion as shown by arrows 78 so as to concurrently periodically approach, contact and withdraw from a surface of the volume of coal 70. The plates 76 transmit a substantially uniform force across all regions of the volume of coal 70. Alternatively, the plates 76, hammers or rollers of the container 52 may be vibrated to compact the volume of coal.

Figure 3E:
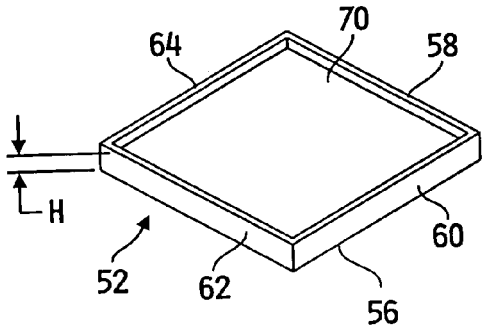

As a result of the force applied in step 74, the bulk density of the coal 70 is substantially uniformly increased. Assuming constant horizontal dimensions, w and l, for the volume of coal 70, the increase in bulk density translates into a decrease (of about 3 or 4 inches) in the vertical dimension, h, of the coal 70, as shown in FIG. 3E. Preferably, this corresponds to a coke apparent specific gravity of 1.05±0.05, taking into consideration experimental and other error which may arise. At the present time, it is believed that a coke apparent specific gravity significantly above about 1.1 may decrease the advantageous characteristics of the blast furnace coke produced using compacted coal.

Figure 3F:
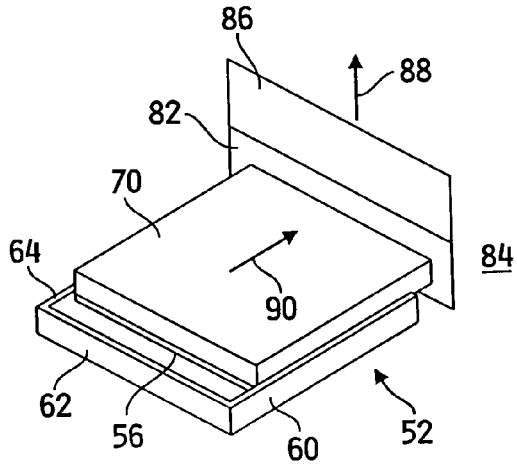

At this point, the compacted coal 70 is ready to be moved from the container 52 at a step 80. As shown in FIG. 3F, the container 52 is preferably disposed adjacent to an opening 82 in a non-recovery oven 84. The opening 80 is selectively coverable by a door 86, which is shown in an open state in FIG. 3F wherein the door has been moved in the direction of an arrow 88 to expose the opening 82. The side wall 58 is removed from the container 52, and the bottom wall 56 and the compacted coal 70 are separated from the side walls 60, 62, 64. The bottom wall 56 and the compacted coal 70 are then introduced into the oven 84, as indicted by an arrow 90. The bottom wall 56 and the compacted coal 70 have a horizontal dimension which is slightly smaller than that of the opening 82 and the interior of the oven 84 to prevent contact with the rim of the opening 82 or the interior walls (not shown) of the oven 84.

Figure 3G:
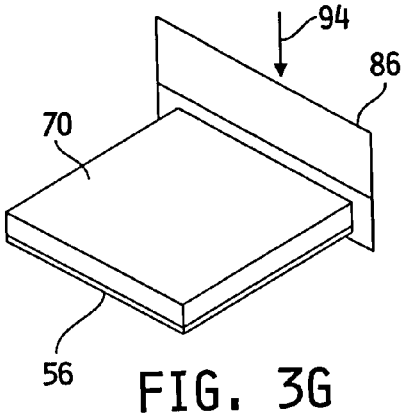
Figure 3H:
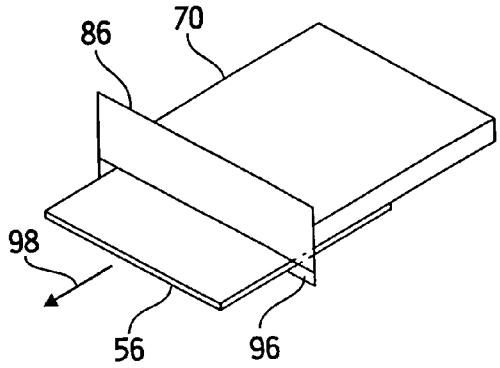

Before carbonization, the bottom wall 56 of the container 52 is withdrawn from the interior of the oven 84 at a step 92. To achieve this, as shown in FIGS. 3G and 3H (with the oven 84 removed for clarity), the door 86 of the oven 84 is lowered (as indicated by an arrow 94) to cover most of the opening 82, leaving just enough of a gap 96 to allow the bottom wall 56 to be withdrawn. The bottom wall 56 is then withdrawn (as indicated by an arrow 98), the door 86 preventing the coal 70 from being carried out of the oven 84 with the bottom wall 56. With the bottom wall 56 withdrawn from the oven 84, the bottom wall 56 and the side wall 58 may be reassembled with the other walls 60, 62, 64 of the container 52, and the steps repeated to prepare another charge for the oven 84.

As discussed above, the substantially uniform compaction of the coal 70 will result in greater interaction between coal particles, improving yield and quality (strength and physical characteristics) and limiting coke breakage, coke loss, and coke emissions. Compaction would also reduce coal particle emission during charging. Also, by achieving a substantially uniform compaction, the coke rate throughout the volume of compacted coal should be fairly uniform, and the coking process may be further optimized given the uniformity of the coal mass. Also, uniformity in heating will result in better utilization of energy. Additionally, because the coal 70 is better able to maintain its shape upon insertion into the oven 84, there will be a reduction in coal ash fusion reactions with the oven wall refractory bricks.

Figure 4:
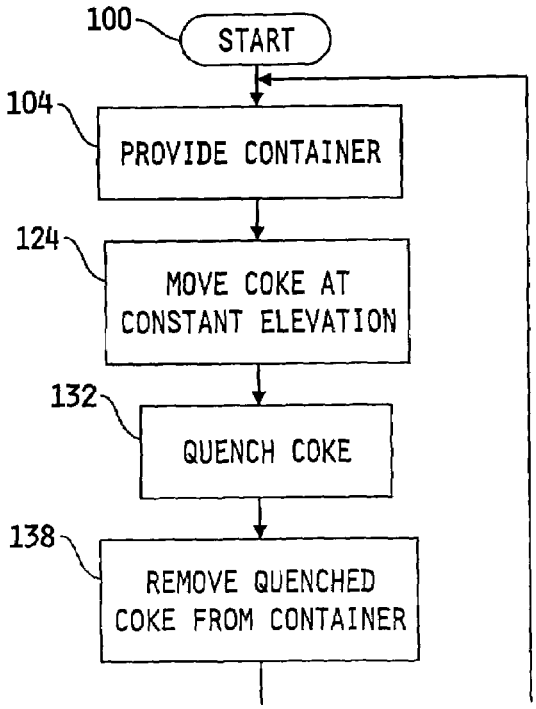
FIG. 4 is a flowchart of a method of removing a coke mass from a non-recovery type oven according to the present invention.

The post-carbonization stage 26 is shown in FIGS. 4 and 5. FIG. 4 shows the steps of the post-carbonization stage 26 in greater detail than is shown in FIG. 1, while FIGS. 5A-5D illustrate the apparatus used for carrying out the steps of the post-carbonization stage 26.

Figure 5A:
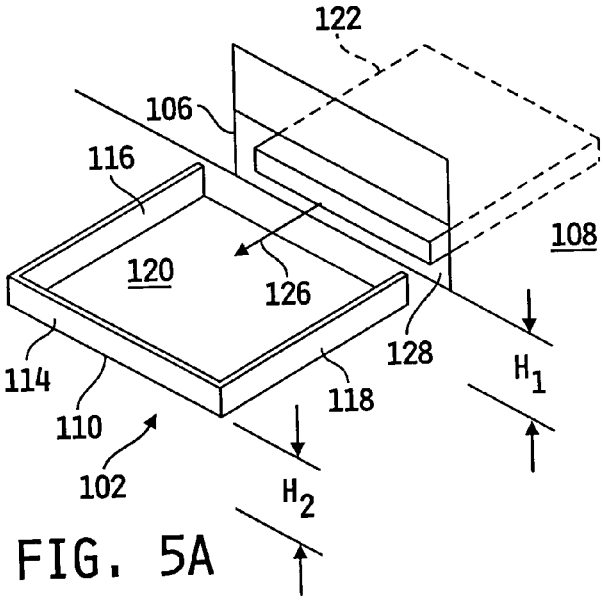
FIGS. 5A-5D are schematic views of an apparatus for removing a coke mass from a non-recovery type oven according to the present invention.
Figure 5B:
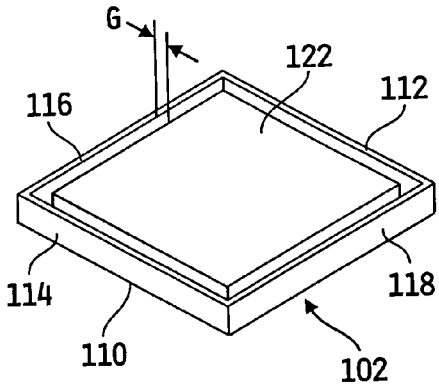

The post-carbonization stage 26 starts with a step 100. A container 102 is provided at a step 104 adjacent to an opening 106 in a non-recovery type oven 108, as shown in FIG. 5A. The container 102, as also shown in FIG. 5B, is, for example, a parallelepiped-shaped structure with at least five walls: a bottom wall 110 and four side walls 112 (not shown in FIG. 5A), 114, 116, 118. The walls 110, 112, 114, 116, 118 define a space 120 for receiving coke 122 from the oven 108. Preferably, as shown in FIG. 5B, the container is designed to provide a gap, g, between the coke 122 and the interior surfaces of the walls 112, 114, 116 118.

Having provided the container 102, the wall 112 is separated from the container 102, and at a step 124, the coke 122 is moved from the oven 108 into the space 120 at a constant elevation, as indicated by an arrow 126. To further elaborate, the oven 108 has a floor 128 which is a vertical distance $H_1$ above a reference point. The bottom wall 110 of the container 102 is a vertical distance $H_2$ above the same reference point. Preferably, the vertical distances $H_1$ and $H_2$ are substantially equal, i.e. the floor 128 and the bottom wall 110 are at the same elevation. Some slight deviation (one to five inches lower, for example) is acceptable between the distances $H_1$ and $H_2$, but the greater the differential, the higher the risk of breakage, which is to be avoided. A top wall may be added to the container 102 so that the coke mass is fully enclosed once it is removed from the oven 108.

With the coke 122 in the container 102, the container 102 is moved to a quenching station 130 (FIG. 5C) where the coke 122 will be cooled. To permit movement of the container 102, the container 102 may be mounted on a wheeled cart or car (not shown), which may be capable of unrestricted movement or may be guided along a predetermined path, for example through the use of rails. Preferably, the bottom wall 110 of the container 102 is maintained at a substantially constant level as the container 102 is transported between the oven 108 and the quenching station 130.

Figure 5C:
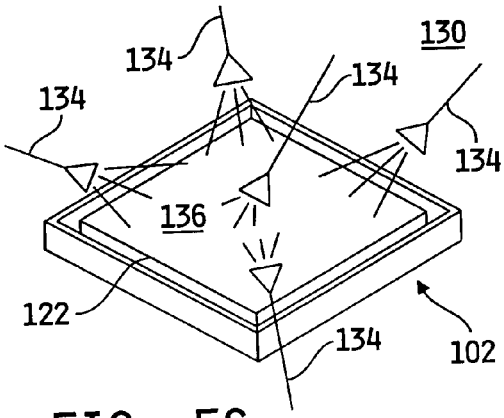

At a step 132, the coke 122 is quenched. The coke 122 may be quenched using a variety of processes, one of which is shown in FIG. 5C. As shown, a plurality of sprayers 134 are provided, connected to a source of quenching material (not shown). If a top wall has been added to the container 102 previously, then it may be removed at this point in the process. The sprayers 134 are pointed at regions of the coke 122, and direct the quenching material, for example water, onto a surface 136 of the coke 122. Given that the volume and shape of the coke 122 is known, the sprayers 134 may be adjusted to fully and evenly quench the coke 122. Alternatively, the container 102 may be filled with a predetermined amount of water. As a further alternative, with a top wall attached, the container 102 may be cooled externally using a water jacket to allow for energy recovery. Moreover, liquid nitrogen may be used in place of water either inside or outside as the quenching material.

Figure 5D:
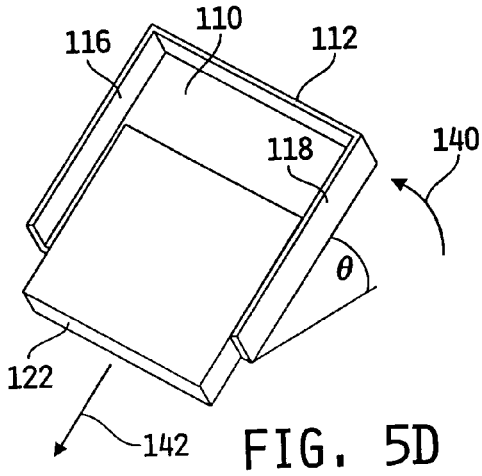

After quenching, the quenched coke 122 may be removed from the container 102 by disposing the container 102 at an angle, θ, to the horizontal at a step 138 as shown in FIG. 5D. In particular, one of the walls 112, 114, 116, 118 is separated and removed from the container 102. The container 102 is then disposed at the angle θ as indicated by an arrow 140, and the coke 122 slides from the container 102 as indicated by an arrow 142. Alternatively, the container 102 could be maintained at a constant level, and the coke 122 pushed from the container 102. Once the coke 122 is removed from the container 102, the container 102 may be returned to the oven 108 to be filled with a new substantially uniform coke mass from the oven 108.

The advantages of the post-carbonization stage 26 described above are numerous. By reducing coke breakage caused by falling, contact with hard surfaces, contact with other cokes, etc., the coke yield will increase. Furthermore, less coke breakage also results in less surface area for coke exposed to air and air currents, again resulting in increased yield by limiting coke oxidation. Less breakage and fewer exposed surfaces result in a reduction of fine particle generation, thus significantly limiting or eliminating particle emissions. Consistent size of coke mass provides for lower average coke moisture and average variation in moisture because the uniformity in coke mass allows for the quenching process to be optimized. Moreover, by combining the pre- and post-carbonization stages, the quenching process may be even more effectively optimized because of the increased uniformity of the charge, which in turn produces an even more consistent coke mass geometry. By enclosing the coke, the energy recovery will be improved, and the emissions will be decreased.

Although the present invention has been shown and described in detail, the same is to be taken by way of example only and not by way of limitation. Numerous changes can be made to the embodiments described above without departing from the scope of the invention. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of producing coke comprising the steps of:

disposing a volume of coal into a non-recovery type oven having an oven floor;

heating the volume of coal to produce a coke mass having an apparent specific gravity of about 1.05;

providing a container;

moving the coke mass from the oven at a substantially constant elevation to the container;

quenching the coke mass in the container to produce a quenched coke mass, wherein the step of quenching comprises the step of applying a volume of water to the coke mass in the container to produce a quenched coke mass; and removing the quenched coke mass from the container.

2. A method of producing coke comprising the steps of:

disposing a volume of coal into a non-recovery type oven having an oven floor;

heating the volume of coal to produce a coke mass having an apparent specific gravity of about 1.05;

providing a container;

moving the coke mass from the oven at a substantially constant elevation to the container;

quenching the coke mass in the container to produce a quenched coke mass, wherein the step of quenching comprises the step of recovering the heat transferred to the volume of water by the coke mass; and removing the quenched coke mass from the container.

3. A method of producing coke comprising the steps of:

disposing a volume of coal into a non-recovery type oven having an oven floor;

heating the volume of coal to produce a coke mass having an apparent specific gravity of about 1.05;

providing a container;

moving the coke mass from the oven at a substantially constant elevation to the container;

quenching the coke mass in the container to produce a quenched coke mass, wherein the step of quenching comprises the step of applying liquid nitrogen to the coke mass in the container to produce a quenched coke mass; and removing the quenched coke mass from the container.

4. A method of producing coke comprising the steps of:

providing a first container;

disposing a volume of loose coal into the first container such that a vertical dimension of the volume of loose coal in the first container is smaller than a horizontal dimension of the volume of loose coal;

applying a force to the volume of loose coal in the first container to produce a volume of coal forming a single compact having a density which is greater than that of the loose coal disposed in the first container;

disposing the volume of the single compact of coal into a non-recovery type oven having an oven floor;

heating the volume of the compact of coal to produce a coke mass;

providing a second container;

moving the coke mass from the oven at a substantially constant elevation to the second container;

quenching the coke mass in the second container to produce a quenched coke mass; and removing the quenched coke mass from the second container.

* * * * *

UNITED STATES PATENT AND TRADEMARK OFFICE

CERTIFICATE OF CORRECTION

PATENT NO. : 7,611,609 B1
APPLICATION NO. : 09/846829
DATED : November 3, 2009
INVENTOR(S) : Valia et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1236 days.

Signed and Sealed this

Twelfth Day of October, 2010

David J. Kappos

David J. Kappos
*Director of the United States Patent and Trademark Office*